United States Patent [19]

Nozawa

[11] Patent Number: 4,838,160

[45] Date of Patent: Jun. 13, 1989

[54] SHEET-FED ROTARY PRINTING PRESS

[75] Inventor: Kenji Nozawa, Ibaraki, Japan

[73] Assignee: Komori Printing Machinery Co., Ltd., Japan

[21] Appl. No.: 126,581

[22] Filed: Nov. 30, 1987

[51] Int. Cl.[4] ..... B41F 5/02; B41F 7/06; B41F 31/02; B41F 33/00

[52] U.S. Cl. ..... 101/183; 101/408; 101/365

[58] Field of Search ..... 101/216, 183, 232, 233, 101/238, 365, DIG. 24, DIG. 26, 408, 184; 250/572; 356/425

[56] References Cited

U.S. PATENT DOCUMENTS

| | | | |
|---|---|---|---|
| 1,447,334 | 3/1923 | Bacon | 101/408 |
| 3,918,363 | 11/1975 | Southam et al. | 101/183 |
| 4,222,326 | 9/1980 | Mathes et al. | 101/183 |
| 4,409,895 | 10/1983 | Fischer | 101/183 |
| 4,413,562 | 11/1983 | Fischer | 101/408 |
| 4,517,221 | 5/1985 | Holl | 101/184 |
| 4,568,185 | 2/1986 | Leuerer | 356/425 |

FOREIGN PATENT DOCUMENTS

| | | | |
|---|---|---|---|
| 2000082 | 1/1979 | United Kingdom | 101/365 |
| 2073667 | 10/1981 | United Kingdom | 101/365 |
| 2102341 | 2/1983 | United Kingdom | 101/183 |

*Primary Examiner*—Edgar S. Burr
*Assistant Examiner*—Kimberly L. Asher
*Attorney, Agent, or Firm*—James R. Ignatowski; Remy J. VanOphem

[57] ABSTRACT

An abnormal sheet detecting unit for conventional sheet fed rotary printing presses. This unit includes either a double-diameter cylinder or a support plate which is in contact with a traveling printed sheet in order to keep the sheet taut. The unit further includes a detecting apparatus, arranged above, respectively, the double-diameter cylinder or the support plate, for detecting a printing density of the taut printed sheet.

14 Claims, 2 Drawing Sheets

SHEET-FED ROTARY PRINTING PRESS

BACKGROUND OF THE INVENTION

1. Field of the Invention

The present invention relates to a sheet-fed rotary printing press.

2. Description of the Prior Art

Sheet-fed rotary printing presses are classified into a lithographic press, a letterpress machine, and an intaglio printing press in accordance with the types of plates used. Of these printing presses, a multicolor lithographic press is arranged as shown in a schematic side view of FIG. 4. In FIG. 4, a printing press 1 consists of a paper sheet feeder 2, a plurality of printing units 3, and a delivery apparatus 4. The paper sheet feeder 2 consists of a stack board 6 which is automatically moved vertically while supporting paper sheets 5 thereon, and a paper pick-up device (not shown), arranged above the sheets 5, for drawing the paper sheets 5 by suction one by one from the uppermost sheet and feeding the drawn sheets onto a feedboard 7. Each printing unit 3 consists of a plate cylinder 8, a blanket cylinder 9, and an impression cylinder 10, which are in contact with each other. A transfer cylinder 11 and a transfer cylinder 12 having a diameter twice that of the transfer cylinder 11 are disposed between the impression cylinders 10 of the adjacent printing units 3, so that their peripheral surfaces are in contact with each other. Swing grippers 13 are arranged obliquely above the impression cylinder 10 of the first color, and a delivery cylinder 14 is in contact with the last impression cylinder 10. Reference numerals 15 denote a right and left sprocket which is coaxially supported on each end of the delivery cylinder 14. A right and left delivery chain 18 is looped respectively between the sprockets 15 and a right and left sprocket 17 disposed at the front end portions of a delivery frame 16 so as to be adjustable by adjustable right and left sprockets 19. A plurality of delivery grippers (not shown ) are arranged in parallel on a gripper rod (not shown ) suspended between the right and left delivery chains 18 at equal intervals. A stack board 20 which is automatically moved vertically while supporting the sheets 5 thereon is arranged below a rear end portion of a conveyance path of the delivery chains 18. These devices are driven from the side of the transfer cylinder 12 for the first color by a motor 21.

With the above arrangement, the sheets 5 on the stack board 6 drawn by suction by the paper pick-up device (not shown) are gripped one by one by the swing grippers 13 and are then gripped by grippers of the impression cylinder 10. When the sheet 5 which is conveyed while being alternately gripped by the grippers of the impression cylinders 10 and the transfer cylinders 11 and 12 passes between the blanket cylinder 9 and the impression cylinder 10 for each color, an image transferred on the blanket surface of the blanket cylinder 9 from a plate surface is transferred onto the sheet 5, thus performing printing. The sheet 5 on which an image of the final color is printed is regripped from the impression cylinder 10 to the delivery grippers of the delivery chains 18 upon cooperation of the delivery cylinder 14, and is then conveyed by the delivery chains 18 which travel in a direction indicated by an arrow in FIG. 4. Thereafter, the sheet 5 is released from the grippers at the rear end portion of the conveyance path, and is stacked on the stack board 20.

In the printing operation described above, misregistration, contamination with oil, offset, and the like occur due to various causes. An abnormal sheet must be removed so as not to be mixed in and stacked together with the normal sheets.

For this purpose, an abnormal sheet detecting apparatus has been recently developed. In this apparatus, pixels from the leading edge to the trailing edge of sequentially conveyed printed products are detected using a sensor or a camera, and a difference between the detected density and a density of pixels of a reference image is discriminated, so that an abnormal sheet is delivered onto a separate delivery tray or a mark is printed on the abnormal sheet in accordance with the discrimination signal. Some users want to add the detecting apparatus to their printing press.

However, in order to accurately operate the abnormal sheet detecting apparatus, an apparatus for tensioning a printed product as an object to be detected during detection must be provided, and the abnormal sheet detecting apparatus must be provided on the downstream side of the paper path of the final printing unit. Therefore, if this apparatus is provided to the existing printing press, the printing press must be greatly modified. However, since most of printing presses cannot be modified, the above detecting apparatus has not yet been used in practical applications although it is in demand.

SUMMARY OF THE INVENTION

It is a principal object of the present invention to provide a sheet-fed rotary printing press in which the quality of printed products can be improved.

It is another object of the present invention to provide a sheet-fed printing press in which installation cost can be greatly reduced.

In order to achieve the above objects, there is provided a sheet-fed rotary printing press which includes an abnormal sheet detecting unit which consists of a printed sheet stabilizing unit which is in contact with a traveling printed sheet to keep the sheet taut and a detecting apparatus arranged above the printed sheet stabilizing unit for detecting the printing density of the taut printed sheet.

BRIEF DESCRIPTION OF THE DRAWINGS

FIGS. 1 to 3 show a sheet-fed rotary printing press according to an embodiment of the present invention, in which:

FIG. 1 is a schematic side view of a multicolor lithographic sheet-fed rotary printing press to which the present invention is applied;

FIGS. 2 and 3 are schematic side views of a multicolor lithographic sheet-fed rotary printing press according to other embodiments of the present invention.

DETAILED DESCRIPTION OF THE PREFERRED EMBODIMENTS

Figure 1:
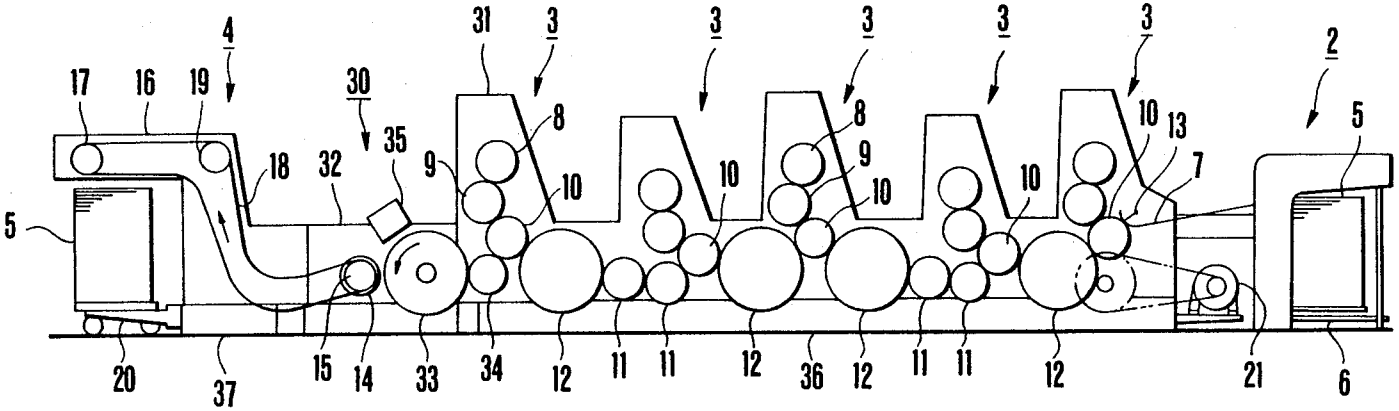

FIG. 1 shows a multicolor lithographic sheet-fed rotary printing press to which the present invention is applied. Since the arrangement of most of the paper sheet feeder, the printing units, and the delivery apparatus of this embodiment are the same as that of the prior art printing press having no abnormal sheet detecing apparatus, shown in FIG. 4, the same reference numerals in FIG. 4 denote the same parts as in FIG. 1, and a detailed description of those conventional aspects will be omitted.

Figure 4:
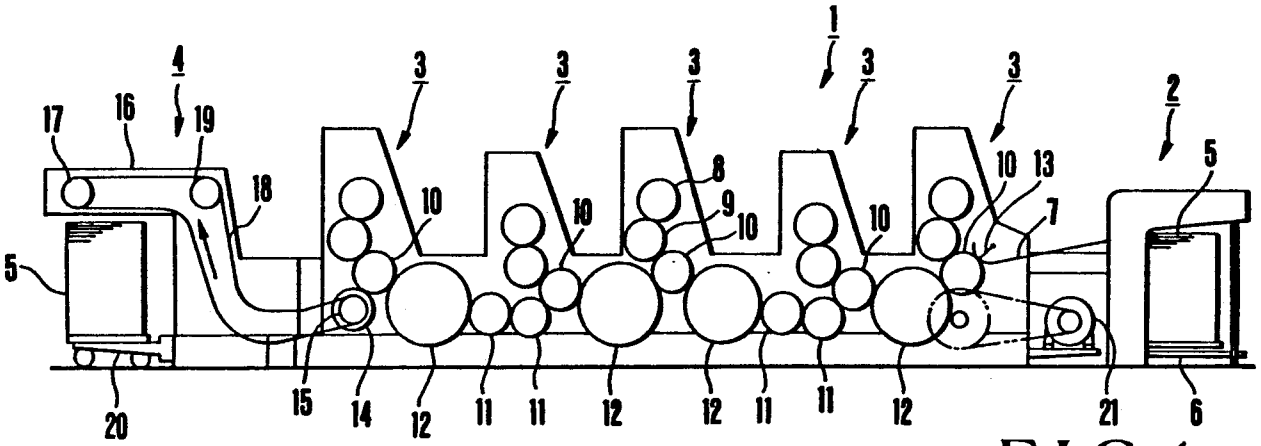
FIG.4 PRIOR ART
FIG. 4 is a schematic side view of a conventional multicolor lithographic sheet-fed rotary printing press as used in the prior art.

An abnormal sheet detecting unit 30 is provided between a final printing unit 3 and a delivery apparatus 4. The abnormal sheet detecting unit 30 consists of a pair of right and left frames 32 for coupling a frame 31 of the printing unit 3 and a delivery frame 16. A double-diameter transfer cylinder 33 serving as both a conveyance means and a printed sheet stabilizing means is axially supported between the frames 32. A transfer cylinder 34 is axially supported by bearings which are used conventionally to axially support the delivery cylinder 14 of FIG. 4, so that the peripheral surface of the transfer cylinder 34 is in contact with the peripheral surfaces of an impression cylinder 10 and the double-diameter transfer cylinder 33. The delivery cylinder 14 which is shown to be in contact with the impression cylinder 10 in FIG. 4 is now axially supported by the right and left frames 32 so as to be in contact with the double-diameter cylinder 33 in the abnormal sheet detecting unit 30 as shown in FIG. 1. Delivery chains 18 are looped around the same sprockets 15 as those in FIG. 4 and coaxially mounted on the delivery cylinder 14. A printed paper sheet 5 is regripped from grippers of the impression cylinder 10 to grippers of the transfer cylinder 34, and is then regripped and conveyed by grippers of the double-diameter transfer cylinder 33 while being in contact with the peripheral surface of the transfer cylinder 33. Thereafter, the sheet 5 is regripped by grippers of the delivery chains 18 and is thereupon conveyed thereby. A detecting apparatus 35 is arranged above the double-diameter transfer cylinder 33 so as to detect a printing density of pixels from one end to the other end of the sheet 5 while it is being conveyed during its period of contact with the double-diameter transfer cylinder 33. Then, the detecting apparatus 35 discriminates a difference between the detected density and a printing density of pixels of a reference image. If a difference is detected, the detecting apparatus 35 generates a signal. Note that beds 36 and 37 on which the printing units 3 and the delivery apparatus 4 are placed are now extended by a length corresponding to the frames 32 and coupled to each other as may be seen by comparison of FIG. 4 with FIG. 1.

With the above structure, when the printed sheets 5 are conveyed while being in contact with the double-diameter transfer cylinder 33, the printed densities of the sheets are detected by the detecting apparatus 35 one by one. If a difference between the detected density and the density of the reference image is found due to contamination with oil, offset, misregistration, or the like, i.e., an abnormal sheet is detected, the detecting apparatus 35 generates a signal. This signal is sent to the delivery apparatus 4 through, e.g., a timer. When the abnormal sheet arrives at the gripper release portion of the delivery apparatus 4, it is delivered to another path separated from the stack board 20, or a tape is inserted on the abnormal sheet to easily distinguish the abnormal sheet from the normal sheets. In this case, since the sheet 5 is in contact with the double-diameter transfer cylinder 33 and as a result is kept taut thereby, stable and precise detection can be realized.

In order to dispose the abnormal sheet detecting apparatus, the printing press need only be modified such that the frames 32, the double-diameter cylinder 33, and the transfer cylinder 34 are additionally provided, and the delivery cylinder 14 is shifted. The existing bearings for the transfer cylinder 34 can be used without modification as well as the printing units 3 and the delivery apparatus 4, thus allowing easy modification.

Figure 2:
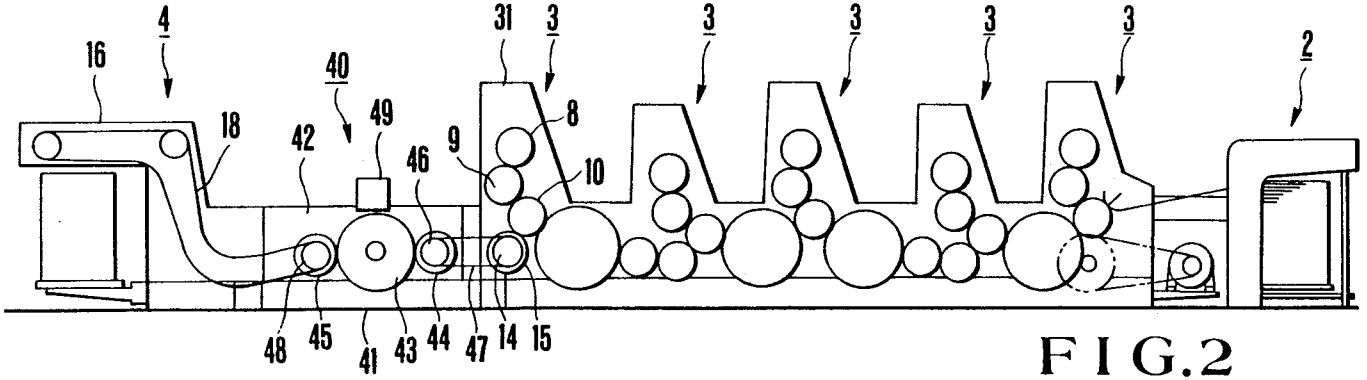

FIG. 2 shows a multicolor lithographic rotary printing press according to another embodiment of the present invention. Only the modified portion according to the present invention will be described below. An abnormal sheet detection unit 40 consisting of right and left frames 42, which couple a frame 31 of a printing unit 3 and a frame 16 of a delivery apparatus 4, and are placed on an additional bed 41. A double-diameter transfer cylinder 43 is axially supported between the frames 42. A transfer cylinder 44 and a delivery cylinder 45 are axially supported to face aach other on the upstream and downstream sides of the paper path of the double-diameter transfer cylinder 43. A pair of right and left conveyance chains 47 consisting of grippers are looped between sprockets 46 coaxially mounted on the transfer cylinder 44 and existing sprockets 15. Existing delivery chains 18 are extended on sprockets 48 coaxially provided on the delivery cylinder 45. Reference numeral 49 denotes the same detecting apparatus as in FIG. 1.

With the above structure, a printed sheet 5 is conveyed to be regripped from grippers of an impression cylinder 10 to grippers of the conveyance chains 47, and is then conveyance to be regripped by the grippers of the double-diameter transfer cylinder 43 while being in contact with the surface of the transfer cylinder 43. Thereafter, the sheet 5 is conveyed to be regripped by the grippers of the delivery chains 18. The sheet 5 is detected while being in contact with the double-diameter transfer cylinder 43, i.e., in a taut state so that precise detection can be performed. Components which are added for reconstruction are the bed 41, the frames 42, the double-diameter transfer cylinder 43, the transfer cylinder 44, the delivery cylinder 45, the sprockets 46 and 48, and the chains 47. Other existing components can be utilized, resulting in easy modification.

Figure 3:
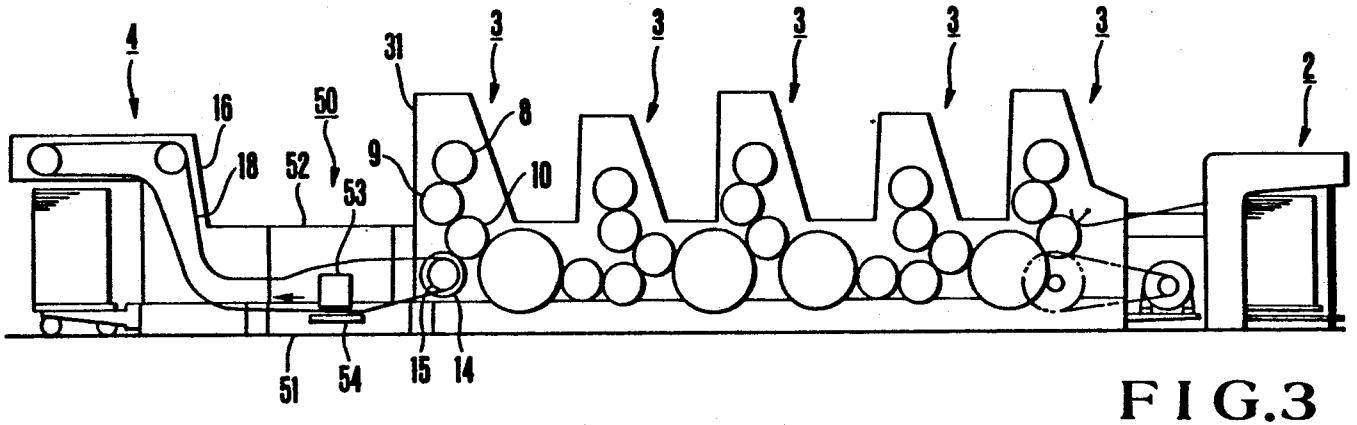

FIG. 3 shows a multicolor lithographic rotary printing press according to still another embodiment of the present invention. Only the modified portion according to the present invention will be described below. An abnormal sheet detecting unit 50 consists of right and left frames 52 which couple a printing unit 3 and a frame 16 of a delivery apparatus 4, and are placed on an additional bed 51. Delivery chains 18 are extended by a length corresponding to the frames 52. A detecting apparatus 53 is arranged within a conveyance path of the delivery chains 18. A support plate 54 is provided below the detecting apparatus 53 in order to stabilize the conveyed sheet by contact therewith.

With the above structure, the sheet 5 is conveyed by the delivery chains 18 and is detected by the detecting apparatus 53 while it is in stabilizing contact with the support plate 54, i.e, in a taut state. Therefore precise detection is attained . In order to dispose the abnormal sheet detecting apparatus, the bed 51, the frames 52 and the support plate 54 are added, and the delivery chains 18 are extended, resulting in easy modification.

In each of the above described embodiments, a printing density detected by the detecting apparatus 35, 49, or 53 can be displayed on a display unit. In the above described embodiments, the present invention is applied to a multicolor lithographic rotary printing press, but the present invention can be applied, based upon the disclosure herein and with ordinary skill in the art, to a monochromatic printing press, a letterpress machine, and an intaglio printing press.

As can be understood from the above description, according to the present invention, an abnormal sheet detecting unit consisting of a printed sheet stabilizing means is in contact with a traveling printed sheet to keep the sheet taut and a detecting apparatus for detecting a printing density of the tensed printed sheet is arrangd between a printing unit and a delivery apparatus, so that the conveyed sheet is detected while being in contact with the printed sheet stabilizing means, i.e., in a taut state. Therefore, an abnormal sheet can be precisely detected, and quality of a printed product can be improved. In addition, when an existing printing press is modified to be one having an abnormal sheet detecting apparatus, most of the existing portion thereof is utilized without modification, and only some components need be added. Therefore, the cost of equipment can be reduced, and the abnormal sheet detecting apparatus can be easily added. Thus, the detecting apparatus gains popularity, further improving quality of printed products.

What is claimed is:

1. In combination with a sheet-fed rotary printing press for printing a paper sheet of the type wherein a paper sheet feeder is attached to a first printing unit of a printing press having at least one printing unit, and further wherein a paper sheet delivery apparatus is attached to a last printing unit of said printing press having at least one printing unit, said paper sheet printing units and paper sheet delivery apparatus establishing a paper path for said paper sheet from said paper sheet feeder to said paper sheet delivery apparatus, the improvement comprising:

means for separating said paper sheet delivery apparatus from said last printing unit of said printing press having at least one printing unit; and an abnormal sheet detecting unit located between said paper sheet delivery apparatus and said last printing unit of said printing press having at least one printing unit, said abnormal sheet detecting unit comprising:

a first frame member having one end attached to said paper sheet delivery apparatus and an opposite end attached to said last printing unit;

a second frame member located adjacent said first frame member in spaced relationship thereto, said second frame member having one end attached to said paper sheet delivery apparatus and an opposite end attached to said last printing unit;

printed sheet stabilizing means mounted to said first and second frame members for stabilizing said printed sheet, said printed sheet stabilizing means keeping said paper sheet taut; and abnormal sheet detecting means mounted to said first and second frame members and adjacent said printed sheet stabilizing means for detecting a predetermined printing density of ink on said paper sheet while said paper sheet is kept taut by said printed sheet stabilizing means.

2. The combination of claim 1, wherein said printed sheet stabilizing means comprises a double diameter transfer cylinder mounted to said sheet-fed rotary printing press between said first and second frame members.

3. The combination of claim 2, further comprising:

a delivery cylinder mounted to said first and second frame members of said sheet-fed rotary printing press, said delivery cylinder being located downstream of said paper path from said double diameter transfer cylinder, said delivery cylinder being in contact with said double diameter transfer cylinder;

sprocket means coaxially mounted with said delivery cylinder;

delivery chain means having one end looping said sprocket means and an opposite end adapted to cooperate with said paper sheet delivery apparatus for delivering said paper sheet from said delivery cylinder to said paper sheet delivery apparatus;

a transfer cylinder mounted to said last printing unit of said sheet-fed rotary printing press, said transfer cylinder being located upstream of said paper path from said double diameter cylinder, said transfer cylinder transferring said paper sheet from said last printing unit of said sheet-fed rotary printing press to said double diameter transfer cylinder; and a bed extension member extending between said last printing unit of said sheet-fed rotary printing press and said paper sheet delivery apparatus for supporting said first and second frame members.

4. The combination of claim 2, further comprising:

a first delivery cylinder mounted to said first and second frame members of said sheet-fed rotary printing press, said first delivery cylinder being located downstream of said paper path from said double diameter transfer cylinder, said first delivery cylinder being in contact with said double diameter transfer cylinder;

first sprocket means coaxially mounted with said first delivery cylinder;

first delivery chain means having one end looping said first sprocket means and an opposite end adapted to cooperate with said paper sheet delivery apparatus for delivering said paper sheet from said first delivery cylinder to said paper sheet delivery apparatus;

a second delivery cylinder mounted to said last printing unit of said sheet-fed rotary printing press, said second delivery cylinder being located upstream of said paper path from said double diameter transfer cylinder;

second sprocket means mounted coaxially with said second delivery cylinder;

a transfer cylinder mounted to said first and second frame members of said sheet-fed rotary printing press, said transfer cylinder being located between said double diameter transfer cylinder and said second delivery cylinder;

third sprocket means mounted coaxially with said transfer cylinder;

second delivery chain means having one end looping said second sprocket means and an opposite end looping said third sprocket means, said second delivery cylinder transferring said paper sheet from said second delivery cylinder of said last printing unit of said sheet-fed rotary printing press to said second delivery chain means, said transfer cylinder further transferring said paper sheet from said second delivery chain means to said double diameter transfer cylinder; and a bed interposed between said paper sheet delivery apparatus and said last printing unit of said sheet-fed rotary printing press for mounting said first and second frame members thereto.

5. The combination of claim 1, wherein said printed sheet stabilizing means comprises a support plate mounted to said first and second frame members of said sheet-fed rotary printing press, said support plate holding said paper sheet taut.

6. The combination of claim 5, further comprising a bed interposed said last printing unit of said sheet-fed rotary printing press and said paper sheet delivery apparatus, said support plate being mounted to said first and second frame members; said paper sheet delivery apparatus including delivery chain means of predetermined length, said delivery chain means predetermined length including a length thereof substantially equal to that of the length of said bed.

7. An abnormal paper sheet detecting apparatus for retrofitting into an existing sheet-fed rotary printing press having a paper sheet feeder attached to a first printing unit of a printing press having multiple printing units, a paper sheet delivery apparatus attached to a last printing unit of a printing press having multiple printing units, and a paper sheet delivery apparatus establishing a paper path for said paper sheet from said paper sheet feeder to said paper sheet delivery apparatus, said abnormal sheet detecting apparatus comprising:

means for separating said paper sheet delivery apparatus from said last printing unit of said printing press having at least one printing unit; and an abnormal sheet detecting unit located between said paper sheet delivery apparatus and said last printing unit of said printing press having at least one printing unit, said abnormal sheet detecting unit comprising:

a first frame member having one end attached to said paper sheet delivery apparatus and an opposite end attached to said last printing unit;

a second frame member located adjacent said first frame member in spaced relationship thereto, said second frame member having one end attached to said paper sheet delivery apparatus and an opposite end attached to said last printing unit;

printed sheet stabilizing means mounted to said first and second frame members for stabilizing said printed sheet, said printed sheet stabilizing means keeping said paper sheet taut, said printed sheet stabilizing means being located in said sheet-fed rotary printing press between said at least one printing unit and said paper sheet delivery apparatus; and abnormal sheet detecting means mounted to said first and second frame members and adjacent said printed sheet stabilizing means for detecting a predetermined printing density of ink on said paper sheet while said paper sheet is kept taut by said printed sheet stabilizing means.

8. The abnormal paper sheet detecting apparatus of claim 7 wherein said printed sheet stabilizing means comprises a double diameter transfer cylinder mounted to said sheet-fed rotary printing press between said first and second frame members.

9. The abnormal paper sheet detecting apparatus of claim 8, further comprising:

a bed interposed between said paper sheet delivery apparatus and said last printing unit of said sheet-fed rotary printing press for mounting said first and second frame members thereto;

a first delivery cylinder mounted to said first and second frame members, said first delivery cylinder being located downstream of said paper path from said double diameter transfer cylinder, said first delivery cylinder being in contact with said double diameter transfer cylinder;

first sprocket means coaxially mounted with said first delivery cylinder;

first delivery chain means having one end looping said first sprocket means and an opposite end adapted to cooperate with said paper sheet delivery apparatus for delivering said paper sheet from said first delivery cylinder to said paper sheet delivery apparatus;

a second delivery cylinder mounted to said last printing unit of said sheet-fed rotary printing press, said second delivery cylinder being located upstream of said paper path from said double diameter transfer cylinder;

second sprocket means mounted coaxially with said second delivery cylinder;

a transfer cylinder mounted to said first and second frame members, said transfer cylinder being located between said double diameter transfer cylinder and said second delivery cylinder;

third sprocket means mounted coaxially with said transfer cylinder; and second delivery chain means having one end looping said second sprocket means and an opposite end looping said third sprocket means, said second delivery cylinder transferring said paper sheet from said second delivery cylinder of said last printing unit of said sheet-fed rotary printing press to said second delivery chain means, said transfer cylinder further transferring said paper sheet from said second delivery chain to said double diameter transfer cylinder.

10. The abnormal paper sheet detecting apparatus of claim 8, further comprising:

a bed extension member extending between said last printing unit of said printing press and said paper sheet delivery apparatus for supporting said first and second frame members;

a delivery cylinder mounted to said first and second frame members, said delivery cylinder being located downstream of said paper path from said double diameter transfer cylinder, said delivery cylinder being in contact with said double diameter transfer cylinder;

sprocket means coaxially mounted with said delivery cylinder;

delivery chain means having one end looping said sprocket means and an opposite end adapted to cooperate with said paper sheet delivery apparatus for delivering said paper sheet from said delivery cylinder to said paper sheet delivery apparatus; and a transfer cylinder mounted to said last printing unit of said sheet-fed rotary printing press, said transfer cylinder being located upstream of said paper path from said double diameter transfer cylinder, said transfer cylinder transferring said paper sheet from said last printing unit of said sheet-fed rotary printing press to said double diameter transfer cylinder.

11. The combination of claim 10 further comprising:

a delivery cylinder mounted to said last printing unit of said sheet-fed rotary printing press, said delivery cylinder being located upstream of said paper path from said support plate;

sprocket means coaxially mounted with said delivery cylinder;

delivery chain means having one end looping said sprocket means and an opposite end adapted to cooperate with said paper sheet delivery apparatus, said delivery chain means further having a translating portion passing between said support plate and said abnormal sheet detecting means such that as said delivery cylinder delivers said paper sheet from said last printing unit of said sheet-fed rotary printing press to said delivery chain means said translating portion of said delivery chain means carries said printed sheet between said support plate and said abnormal sheet detecting means before delivering said sheet to said paper sheet delivery apparatus.

12. The abnormal paper sheet detecting apparatus of claim 7, wherein said printed sheet stabilizing means comprises a support plate mounted between said first and second frame members, said support plate holding said paper sheet taut.

13. The abnormal paper sheet detecting apparatus of claim 12, further comprising a bed interposed said last printing unit of said sheet-fed rotary printing press and said paper sheet delivery apparatus, said support plate being mounted to said first and second frame members; said paper sheet delivery apparatus including delivery chain means of predetermined length, said delivery chain means predetermined length including a length thereof substantially equal to that of said bed.

14. The abnormal paper sheet detecting apparatus of claim 12 further comprising:

a delivery cylinder mounted to said last unit of said sheet-fed rotary printing press, said delivery cylinder being located upstream of said paper path from said support plate;

sprocket means coaxially mounted with said delivery cylinder;

delivery chain means having one end looping said sprocket means and an opposite end adapted to cooperate with said paper sheet delivery apparatus, said delivery chain means further having a translating portion passing between said support plate and said abnormal sheet detecting means such that as said delivery cylinder delivers said paper sheet from said last unit of said sheet-fed rotary printing press to said delivery chain means said translating portion of said delivery chain means carries said printed sheet between said support plate and said abnormal sheet detecting means before delivering said sheet to said paper sheet delivery apparatus.

* * * * *

UNITED STATES PATENT AND TRADEMARK OFFICE

CERTIFICATE OF CORRECTION

PATENT NO. : 4,838,160

DATED : June 13, 1989

INVENTOR(S) : Kenji Nozawa

It is certified that error appears in the above-identified patent and that said Letters Patent is hereby corrected as shown below:

Column 4, line 11, delete "and".

Column 4, line 15, delete "aach" and insert ---- each ----.

Column 4, line 28, delete "conveyance" and insert ---- conveyed ----.

Column 4, line 57, delete "i.e," and insert ---- i.e., ----; same line, after "Thererfore" insert ---- , ----.

Column 5, line 9, delete "rangd" and insert ---- ranged ----.

Column 5, line 30, delete "print-".

Column 5, line 31, delete "ing units" and insert ---- feeder ----.

Column 8, line 62, delete "10" and insert ---- 5 ----.

UNITED STATES PATENT AND TRADEMARK OFFICE

CERTIFICATE OF CORRECTION

PATENT NO. : 4,838,160

DATED : June 13, 1989

INVENTOR(S) : Kenji Nozawa

It is certified that error appears in the above-identified patent and that said Letters Patent is hereby corrected as shown below:

Claim 10, line 19, after "last" insert --printing--.

Signed and Sealed this

Fourth Day of December, 1990

*Attest:*

HARRY F. MANBECK, JR.

*Attesting Officer*

*Commissioner of Patents and Trademarks*